US008029517B2

(12) United States Patent
Sun et al.

(10) Patent No.: US 8,029,517 B2
(45) Date of Patent: Oct. 4, 2011

(54) EPILATION DEVICE

(75) Inventors: Anita Schu-chiam Shyun Sun, Los Angeles, CA (US); Sara Ella Maita, San Francisco, CA (US)

(73) Assignee: Karmissie, LLC, Alhambra, CA (US)

( * ) Notice: Subject to any disclaimer, the term of this patent is extended or adjusted under 35 U.S.C. 154(b) by 125 days.

(21) Appl. No.: 11/986,148

(22) Filed: Nov. 19, 2007

(65) Prior Publication Data

US 2008/0287964 A1 Nov. 20, 2008

Related U.S. Application Data

(60) Provisional application No. 60/930,360, filed on May 15, 2007.

(51) Int. Cl.
*A61B 17/50* (2006.01)

(52) U.S. Cl. ..... 606/133

(58) Field of Classification Search ..... 606/36, 606/43, 131, 133, 134; 132/122, 214, 323; D28/55

See application file for complete search history.

(56) References Cited

U.S. PATENT DOCUMENTS

| | | | | |
|---|---|---|---|---|
| 4,524,772 | A | 6/1985 | Daar et al. | |
| 4,784,136 | A | 11/1988 | Klein | |
| 4,983,175 | A | 1/1991 | Daar et al. | |
| 5,494,485 | A | 2/1996 | Gabion et al. | |
| 5,643,287 | A * | 7/1997 | Ahad | 606/133 |
| 5,662,662 | A | 9/1997 | Bishop et al. | |
| 5,908,425 | A | 6/1999 | Adam | |
| 5,951,573 | A * | 9/1999 | Yashar | 606/133 |

OTHER PUBLICATIONS

Falguni Shah, The Ancient Art of Eyebrow Threading (DVD), Jacksonville, Florida, Tel.904-381-8686, http://www.seventh-wonder.com/.

* cited by examiner

*Primary Examiner* — Anhtuan Nguyen
*Assistant Examiner* — Jonathan W Miles
(74) *Attorney, Agent, or Firm* — Dariush G. Adli; Adli Law Group P.C.

(57) ABSTRACT

Techniques for implementing an epilation device are described, including a body including a first half and a second half, the first half having a first arm and the second half comprises a second arm, an axle having a third arm disposed at an end of the axle and a fourth arm disposed at another end of the axle, the axle being coupled to a first set of teeth, and a trigger coupled to a spring, the trigger being substantially housed within the body and being partially exposed through an aperture in the body, the trigger further including a second set of teeth configured to engage the first set of teeth.

8 Claims, 13 Drawing Sheets

EPILATION DEVICE

CROSS-REFERENCE TO RELATED APPLICATIONS

This application claims the benefit of U.S. Provisional Patent Application No. 60/930,360 filed May 15, 2007 and entitled "Epilation Device," which is herein incorporated by reference for all purposes.

FIELD OF THE INVENTION

The present invention relates to beauty, skin, and aesthetic care products and, more specifically, to an epilation device.

BACKGROUND

Human hair removal (i.e., epilation) is performed using various types of conventional devices and techniques. Unwanted hair in locations can be extracted partially or entirely (i.e., from the follicle). Using conventional devices and techniques, hair removal is often painful, time-consuming, and performed using skilled technicians, aestheticians, or other personnel. However, conventional epilation devices and techniques are also problematic.

Some conventional devices and techniques use threading as a technique for removing hair. By rolling a length of twisted thread, thin wire, or other filament, hairs may be removed and pulled from surrounding skin (i.e., removal by the follicle). This prevents hair from growing back rapidly, if at all. However, threading is time-consuming and requires highly skilled and trained technicians. By requiring highly skilled and trained technicians (e.g., aestheticians), threading is not only time-consuming, but also expensive and manually intensive.

Thus, a solution for removing hair without the limitations of conventional techniques is required.

BRIEF DESCRIPTION OF THE DRAWINGS

The present invention will be readily understood by the following detailed description in conjunction with the accompanying drawings, and like reference numerals designate like structural elements.

DETAILED DESCRIPTION

Embodiments or examples of the invention may be implemented in numerous ways, including as an apparatus, system, or process. A detailed description of one or more examples is provided below along with accompanying figures. The detailed description is provided in connection with such examples, but is not limited to any particular example. The scope is limited by the claims, but numerous alternatives, modifications, and equivalents are encompassed. Numerous specific details are set forth in the following description in order to provide a thorough understanding. These details are provided for the purpose of example and the descriptions provided may be used for implementation according to the claims without some or all of these specific details. For the purpose of clarity, technical material that is known in the technical fields related to the examples has not been described in detail to avoid unnecessarily obscuring the description. Various alternative implementations and modifications to the examples provided may be used and are not limited to the descriptions, dimensions, or other exemplary details provided herein.

In some examples, an epilation device is described, including a body having a first support, a second support, and a base, arms, where at least one of the arms is coupled to the first support and another of the arms is coupled to the second support, the distal end of each of the arms is coupled to another of the arms using a thread, which has axial twists, a shaft disposed between the first support and the second support, the shaft having at least another arm coupled to the shaft, and a spring axially mounted around another shaft that is configured to rotate the spring and the shaft when a trigger is manipulated, the trigger also being configured to roll the axial twists in at least a lateral direction.

Figure 1:
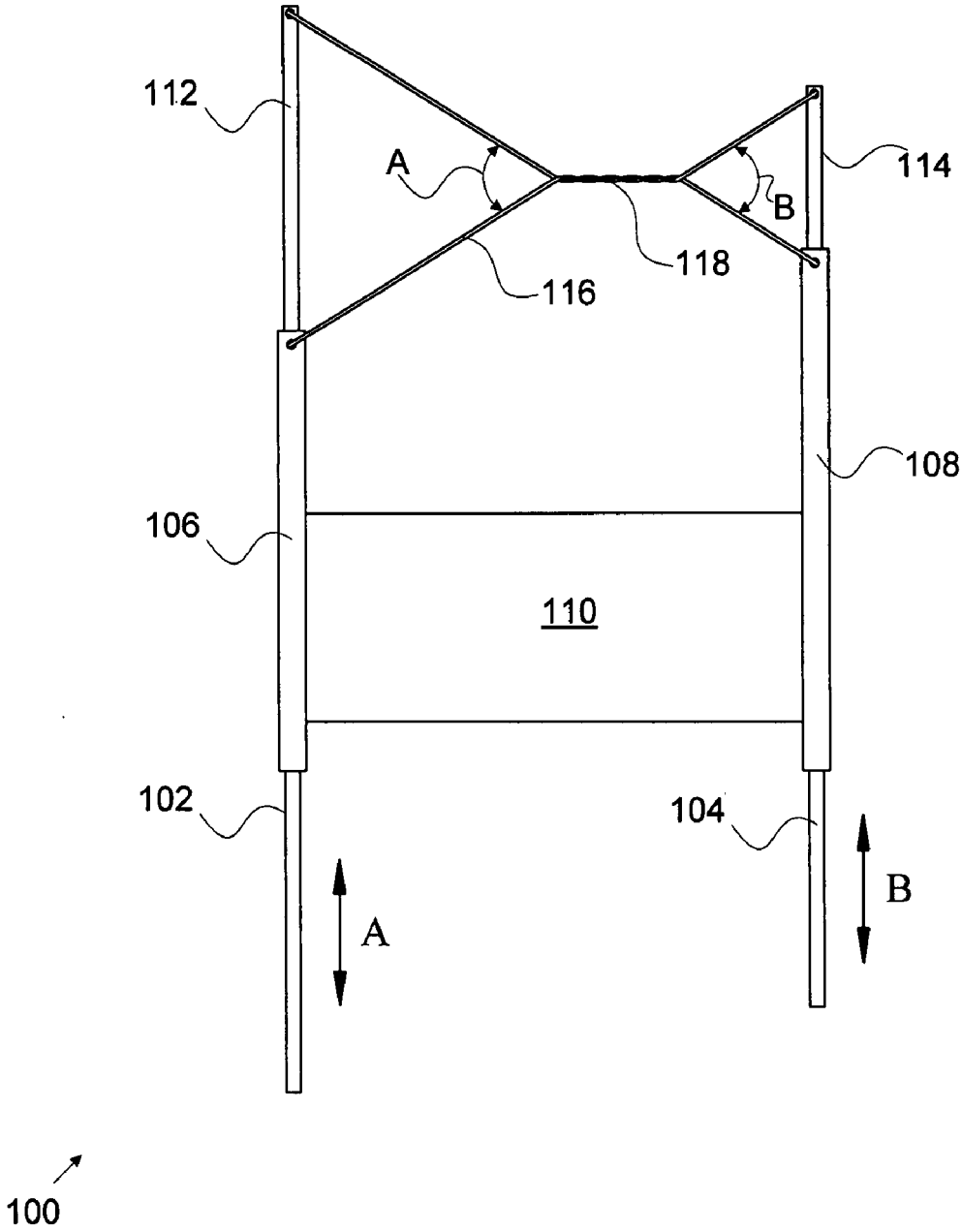
FIG. 1 illustrates an exemplary epilation device.

FIG. 1 illustrates an exemplary epilation device. Here, device 100 includes arms 102-104, sheaths 106-108, lateral support 110, telescoping arms 112-114, thread 116, and axial twists 118. In some examples, the degree, angle, and motion of axial twists 118 may be modified, adjusted, or otherwise manipulated ("manipulated") by adjusting the length of telescoping arms 112-114. For example, arms 102-104 may be moved up or down, as suggested by motion arrows "A" and "B," in order to adjust the angle between telescoping arms 112 and 114. In so doing, axial twists 118 may be rolled from "side to side," from left to right, or from right to left. By holding device 100 in contact with skin having unwanted hair, axial twists 118 may grab and remove hair by the follicle. In other words, by adjusting arms 102-104 and telescoping arms 112-114, axial twists 118 roll back and forth, grabbing and removing hair by the follicle. In other words, axial twists 118 pinch or grasp hair close to the skin and wind the length of the hair protruding above the surface of the skin. Thus, as axial twists 118 move, epilation occurs. In other examples, device 100 and the above-described elements may be varied and are not limited to the descriptions provided.

Figure 2:
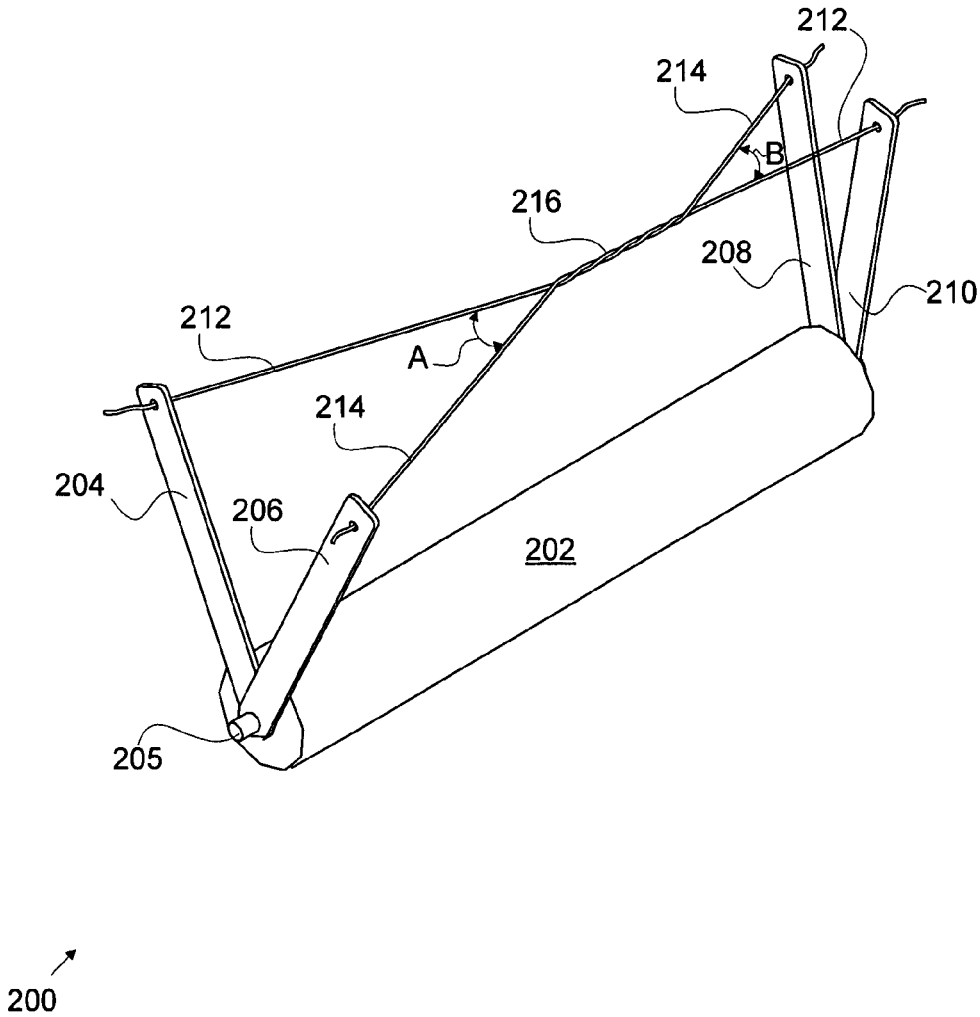
FIG. 2 illustrates an alternative exemplary epilation device.

FIG. 2 illustrates an alternative exemplary epilation device. Here, device 200 includes handle 202, arms 204 and 206-210, shaft 205, thread 212-214, and axial twists 216. In some examples, a user may grasp handle 202 to place axial twists 216 in close proximity or in contact with hair to be epilated. When arms 204, 206-210 are adjusted, angles "A" and "B" may be varied, causing axial twists 216 to move (i.e., roll) from laterally (i.e., from side-to-side, from left to right, from right to left, and the like). As axial twists 216 roll, hair may be grasped or pinched between each twist of axial twists 216 and pulled or extracted from skin. In other examples, device 200 and the illustrated and described elements may be varied.

Figure 3:
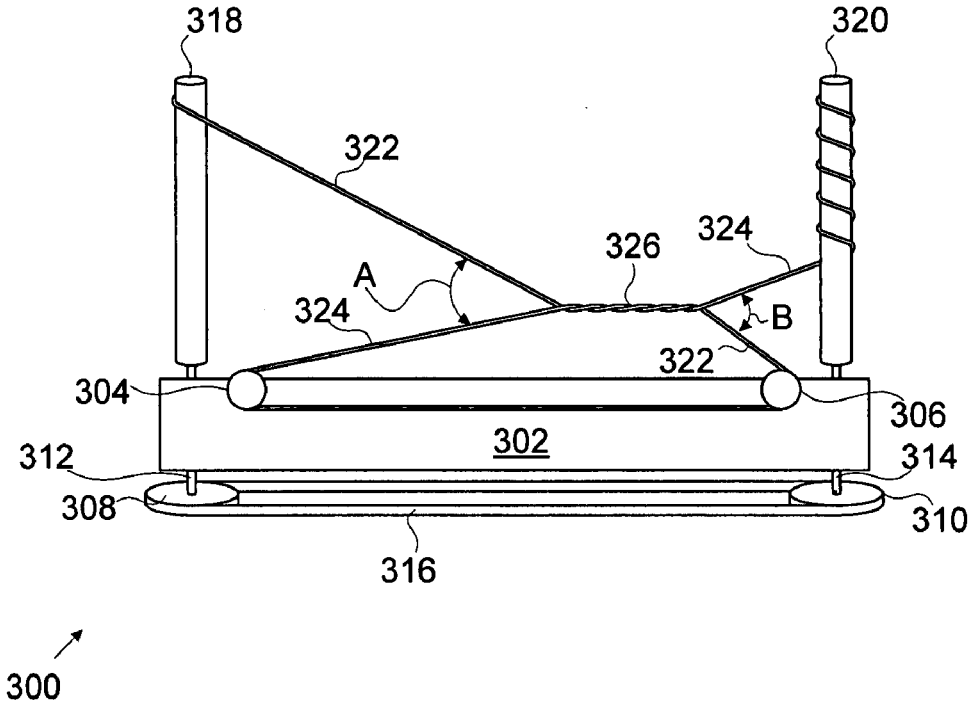
FIG. 3 illustrates another alternative exemplary epilation device.

FIG. 3 illustrates another alternative exemplary epilation device. Here, device 300 includes base 302, pulleys 304-310, shafts 312-314, belt 316, columns 318-320, thread 322-324, and axial twists 326. In some examples, when belt 316 or rollers 308-310 are operated (i.e., rolled, moved, shifted, or otherwise adjusted), threads 322-324 may be wound on columns 318 or 320. Shafts 312-314 couple rollers 308-310, respectively, to columns 318-320, which may be used to wind threads 322 or 324. As threads 322-324 are wound on columns 318 or 320, respectively, angles "A" and "B" are adjusted, causing axial twists 326 to move laterally (i.e., "side-to-side"). By holding device 300 in close proximity or direct contact with hair, extraction may occur, including removal of hair follicles, thus slowing or altogether preventing hair re-growth. In other examples, device 300 and the above-described elements may be varied in structure, function, design, and implementation, and are not limited to the examples provided.

Figure 4A:
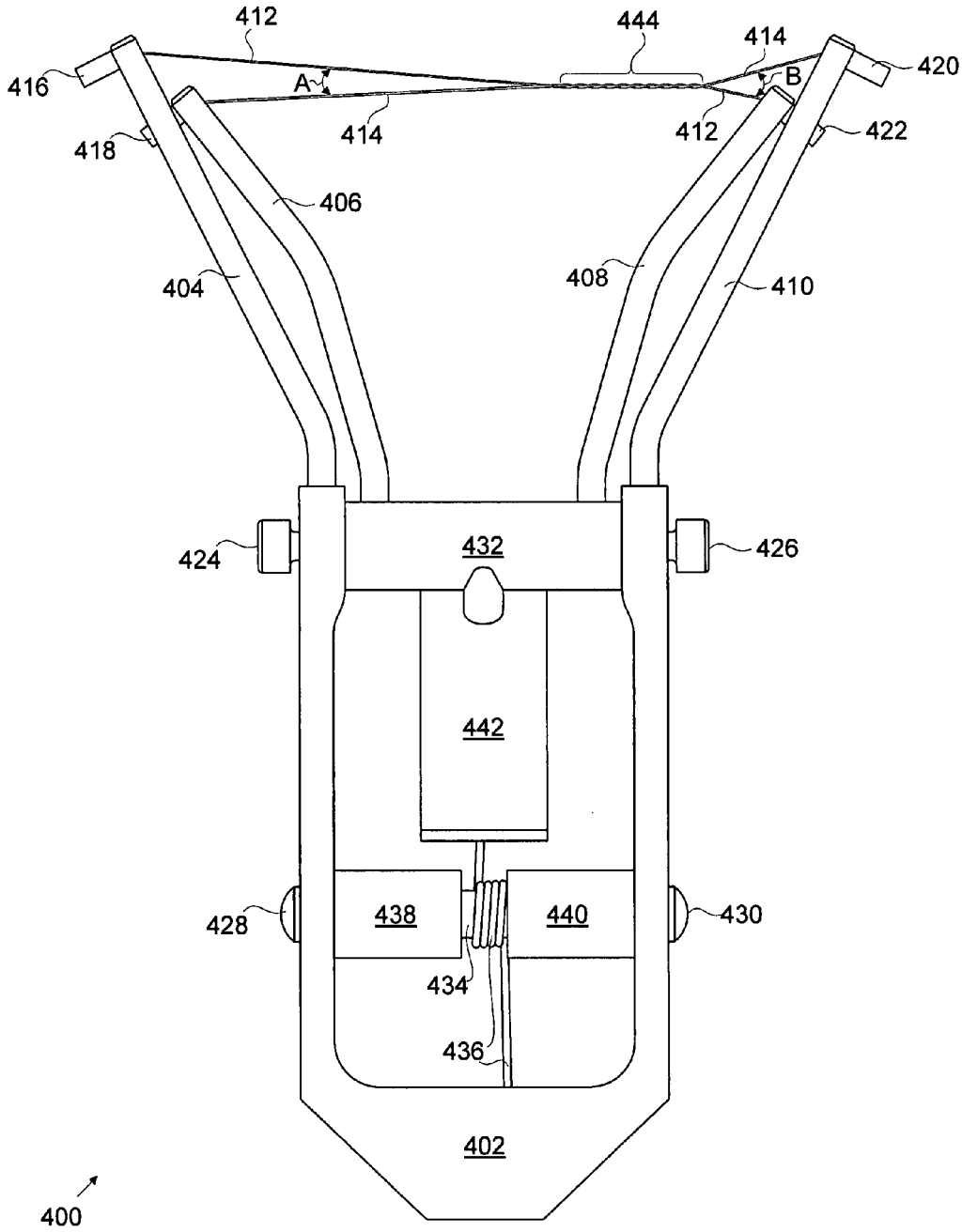
FIG. 4A illustrates yet another alternative exemplary epilation device.

FIG. 4A illustrates yet another alternative exemplary epilation device. Here, device 400 is shown, including body 402, arms 404-410, threads 412-414, retaining pins 416-422, shaft retaining caps 424-430, shafts 432-434, spring 436, shaft covers 438-440, trigger 442, and axial twists 444. In some examples, arms 404 and 410 are coupled to upper supports of body 402. Arms 406-408 are coupled to shaft 432 and, when trigger 442 is manipulated, shaft 432 rolls and causes arms 406-408 to move towards or away from arms 404 and 410. As arms 406-408 move towards or away from arms 404-410, axial twists 444 move laterally. In some examples, body 402 may be formed, fabricated, or otherwise made of materials such as metal (e.g., steel, iron, titanium, and others), wood, plastic, alloys, composite, or other natural or synthetic materials. Further, device 400 and the elements shown may be formed, fabricated, or otherwise made of any type or composition of material and are not limited to any particular type, consistency, strength, or other physical characteristics. Still further, threads 412-414 may be implemented using cotton, wool, steel, wire, or other thin natural or synthetic filaments that, when implemented as shown, may be used for epilation.

Here, when device 400 may be used for epilation by placing axial twists 444 in close proximity or direct contact with hair intended for removal. When trigger 442 is manipulated, hair is grasped or pinched and extracted as axial twists 444 move laterally. In other words, as arms 404-410 move close or further together (i.e., arm 406 moves forward or backward away from arm 404, arm 408 moves forward or backward away from arm 410), angle "A" and "B" are adjusted, causing axial twists 444 to move laterally. In some examples, angles "A" and "B" can increase or decrease within a range of degrees. For example, angles "A" and "B" may adjust between 15 degrees and 170 degrees. As another example, angles "A" and "B" may be configured with a range of motion between 5 and 100 degrees. Alternatively, angles "A" and "B" may be configured to adjust to other angles and are not limited to the examples provided. As these angles are modified, axial twists 444 move left and right. The movement of axial twists 444 is not limited to any particular direction and may be used to epilate (i.e., remove by the follicle) hair from any direction (e.g., left to right, right to left, up and down, or in other directions or angles) When held in contact with skin, axial twists 444 "roll" and epilate hair. In other words, when the twisted portion created by the intertwine of two or more pieces of thread (i.e., disposed between the arms as shown) are held in a flat or substantially flat contact with skin, axial twists 444 roll, causing hairs to become intertwined and gripped between the individual twists of axial twists 444 and epilate hair. In other words, if trigger 442 is moved forward or backward, either by using manual pressure or spring tension, arms 404-410 move, thus causing a wider angle on one side and a narrower angle on the other, enabling axial twists 444 to "roll." As used herein, trigger may refer to any mechanical, electrical, electro-mechanical, piezoelectric, or other type of mechanism, component or element that may be used to transfer kinetic energy from the trigger to axial twist 444 using arms 404-410. A "trigger" may be implemented as a push button, pull trigger, or other type of device in order to move arms 404-410 and, subsequently, cause angles "A" and "B" to vary and to force axial twists 444 to roll. Other angular degree measurements between or including 0 degrees to 100 degrees may be used and device 400 is not limited to those shown and described. Arms 404-410 may be varied in shape, layout, material, or other configuration aspects and are not limited to the examples shown and described. Further, body 402 may also be shaped, designed, or otherwise implemented differently and is not limited to the examples shown and described. For example, body 402 may be designed differently to provide a grip or handle used to hold device 400. Here, body 402 may be designed with dimensions to allow a user to hold device 400, manipulate trigger 442, and epilate hairs with one hand. Thus, greater flexibility and ability to manipulate axial twists 444 are achieved by holding and placing axial twists 444 in close skin contact. In other examples, device 400 and the described elements may be varied in structure, function, design, and implementation, and are not limited to the examples provided.

Figure 4B:
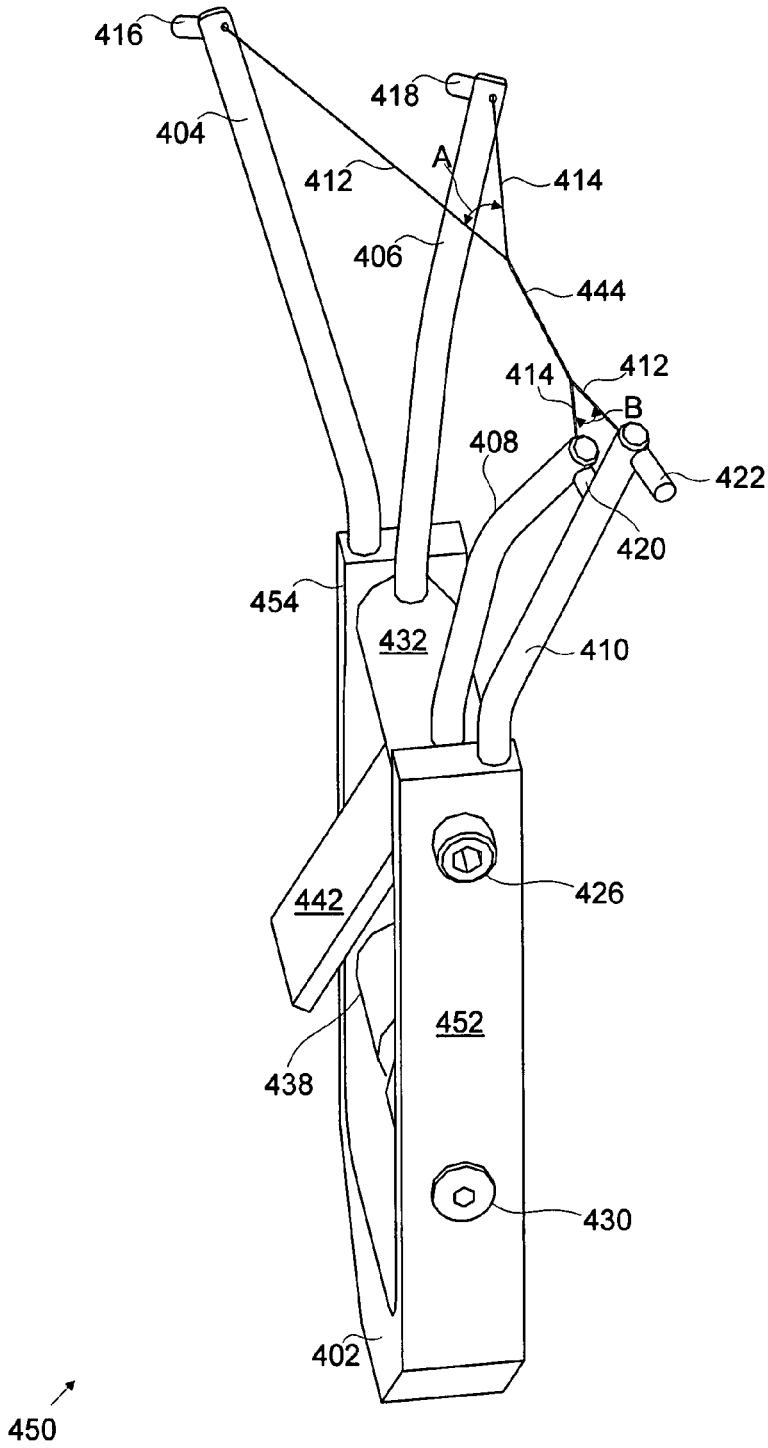
FIG. 4B illustrates another view of an alternative exemplary epilation device.

FIG. 4B illustrates another view of an alternative exemplary epilation device. Here, device 450 is shown, including body 402, arms 404-410, threads 412-414, retaining pins 416-422, shaft retaining caps 424-430, shaft 432, shaft cover 438, trigger 442, axial twists 444, and supports 452-454. In some examples, support 502 may be implemented as an integrated structure of body 402. In other examples, support 502 may be a portion of body 402. In still other examples, support 502 may be formed apart (i.e., separately) from body 402 and coupled directly or indirectly to body 402 using various techniques, including welds, glue, staples, nails, or other techniques. Here, supports 452-454 are formed as part of body 402. Body 402 may be formed using plastic, metal, alloys, composites or other materials, including wood and other natural or synthetic materials.

Here, a side perspective of device 400 is shown, including coupling arm 408 to shaft 432. When trigger 444 is manipulated shaft 432 rotates axially causing arms 406-408 to move. In some examples, arms 404 and 410 may be mounted on support 502 and 504 at vertical and horizontal angles such that when shaft 432 rotates axially, arms 406-408 move closer or farther proximity to arms 404 and 410. As arms 406-408 move closer or farther apart from arms 404 and 410, angles "A" and "B" change, causing threads to laterally move axial twists 444 laterally (i.e., towards or away from retaining pins 416-422). As described above, hair may be grasped or pinched, causing hair to be extracted by the follicle as axial twists continue to roll or move laterally. Alternatively, device 450 and the above-described elements may be varied and are not limited to the examples shown.

Figure 5A:
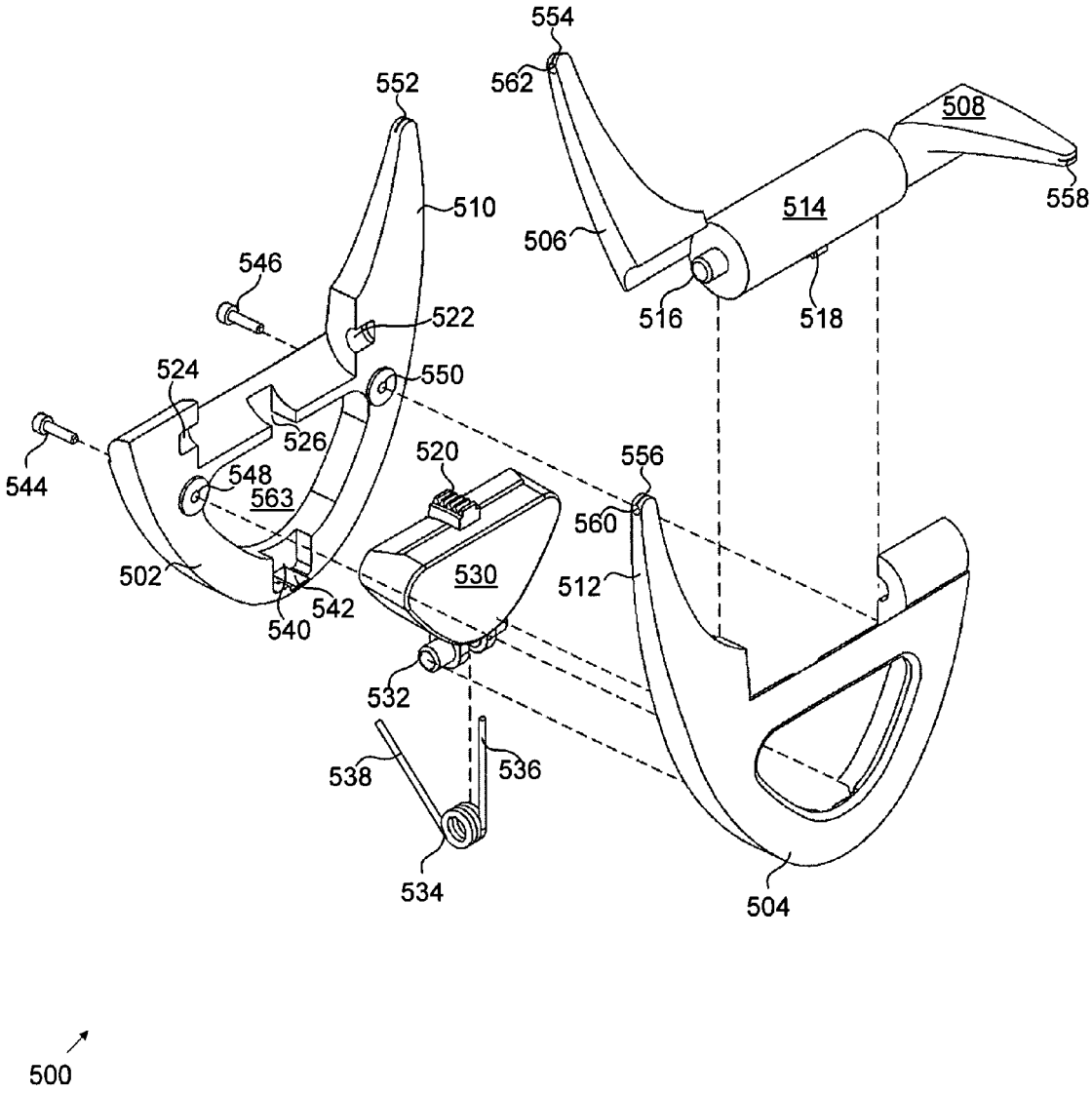
FIG. 5A is an exploded illustration of another exemplary epilation device.

FIG. 5A is an exploded illustration of another exemplary epilation device. Here, device 500 includes rear body 502, front body 504, arms 506-512, axle 514, axis 516, teeth 518-520, axis housings 522-524, teeth housing 526, trigger 530, trigger axis 532, spring 534, spring arms 536-538, trigger axis housing 540, latch 542, pins 544-546, apertures 548-550, thread guides 552-558, and thread receptacles 560-562. In some examples, the quantity, type, form, design, configuration, placement, dimensions, and other characteristics of the above-described elements of device 500 may be varied and are not limited to those shown and described. For example, the number of arms may be varied. Further, the angle of displacement of the arms from an axis running co-planar to rear body 502 and front body 504 may be varied and is not limited to the examples shown and described. As an example, arms 510-512 may be displaced or positioned ("positioned) 0 degrees from a vertical axis co-planar with rear body 502 and front body 504 (not shown). In other examples, arms 510-512 may be positioned to varying degrees away from a vertical or horizontal axis in order to adjust the angle and length of run for threads (not shown) that are twisted and secured at the distal ends of arms 506-512 in thread guides 552-558 and thread receptacles 560-562. As an example, thread guides 552-558 may be implemented as grooves, notches, channels, trenches, clasps, or the like disposed at the distal ends of arms 506-512. Additional thread receptacles may be formed at the distal ends of arms 508-510 and are shown and described below in connection with FIG. 5F.

Referring back to FIG. 5A, device 500 may be assembled by placing spring arm 536 within trigger 530 and aligned with trigger axis 532. Further, when rear body 502 is coupled with front body 504 using pins 544-546 and latch 542, spring arm 538 may be secured within a recession or other housing formed within rear body 502. In other examples, rear body 502 and front body 504 may be coupled using techniques other than pins 544-546, which may be implemented using screws made from various materials, including metal, metal alloys, plastics, composites, synthetic, organic, natural, or other materials. When placed through apertures 548-550, pins 544-546 may be screwed, locked, pressed, pushed, or otherwise secured into receiving housings (not shown) formed on the inside surface of front body 504. Pins 544-546 may be used to secure rear body 502 to front body 504, thus spring 534 under tension enabling trigger 530, when depressed, to engage teeth 518-520. When engaged, teeth 518-520 rotate axle 514 about axis 516, thus causing arms 506 and 512 to close and arms 508-510 to open. In other words, spring 534 provides spring force that causes arms 506 and 512 to open and arms 508-510 to close and, when trigger 530 is pressed into a cavity formed by rear body 502 and front body 504, arms 506 and 512 close and arms 508-510 open. In other examples, arms 506-512 may be configured to operate differently, including in opposite directions, as described. In still other examples, the length, angular offset of arms 506-512, as measured from the horizontal or vertical axis (not shown) of device 500 (i.e., the position of arms 506-508 when loaded under spring tension from spring 534, but prior to a user depressing trigger 530), may be varied and are not limited to the examples provided.

Here, trigger 530 is housed within a cavity formed by a formed depression 563 within the interior of rear body 502 and an opening in front body 504, allowing trigger 530 to partially protrude from front body 504. Trigger axis housing 540 may be used to rest trigger axis 532, providing a fulcrum about which trigger 530 may be depressed and rotated. When trigger 530 is rotated about trigger axis 532, teeth 520 engage trigger 518. Thus, when trigger 530 is depressed into formed depression 563 against spring tension provided by spring 534, teeth 520 engage teeth 518 on axle 514, which may be formed as a single, monolithic component with arms 506-508. In some examples, device 500 and the above-described elements may be formed, made, assembled, manufactured, or otherwise created using various materials and techniques, without limitation. For example, rear body 502 and front body 504 may be formed using molded plastic, metal, metal alloy, plastic, porcelain, or other synthetic or natural materials. As another example, injection molds may be a technique used to form device 500 and the above-described elements. As yet another example, other types of techniques may be used and are not limited to the examples described. Further, device 500 and the above-described elements may be assembled from other parts or elements that are not shown or described. In other examples, device 500 and the above-described elements may be formed, made, assembled, manufactured, or otherwise created using different materials and techniques apart from those shown and described.

Here, arms 506-508 and axle 514 may be formed from multiple pieces and coupled together using adhesives, screws, or other techniques. In some examples, trigger 530 may be configured to be pressed into formed depression 563, causing arms 506-508 to move. Arm 506 may be configured to roll, close, or move toward arm 512. Likewise, when trigger 530 is depressed or pressed ("pressed"), arm 508 may be configured to roll, open, or move away from arm 510. Thus, when arms 506-508 move (i.e., roll when trigger 530 is pressed), threads (not shown) that are twisted together and secured within thread guides 552-558 and thread receptacles 560-562, may be used to engage and epilate hair.

In some examples, when two threads (not shown) are twisted and inserted into thread guides 552-558 and secured into thread receptacles 560-562, a twist may be laterally and axially manipulated to "roll" back and forth between arms 506-512. As a twist (not shown) is placed in contact with a surface to be epilated, pressing trigger 530 closes arms 506 and 512 and opens arms 508-510, causing the twist to roll and extract hair from skin, including the follicle. When trigger 530 is released, arms 506 and 512 open and arms 508-510 close, causing the twist to roll in the opposite direction, engaging hairs within the rolls of the twist, which are subsequently extracted by the follicle from skin placed in contact with the threads used by device 500. In some examples, when hair is engaged by threads twisted and engaged with arms 506-512, a twist may move along more than one axis. In other words, a twist may roll along an axis substantially parallel to device 500 and upwards, providing a rolling motion (i.e., to grab or engage hair) and an upward motion (i.e., to pull or extract the engaged hair) from the surface of the skin. In other examples, the above-described actions may be modified by adjusting the position of spring 534, length or angular offset of arms 506-512, or other characteristics or dimensions of device 500 and the above-described elements. In still other examples, device 500 and the above-described elements may be varied in design, implementation, configuration, dimensions, action, or other aspects and are not limited to the examples shown and described.

Figure 5B:
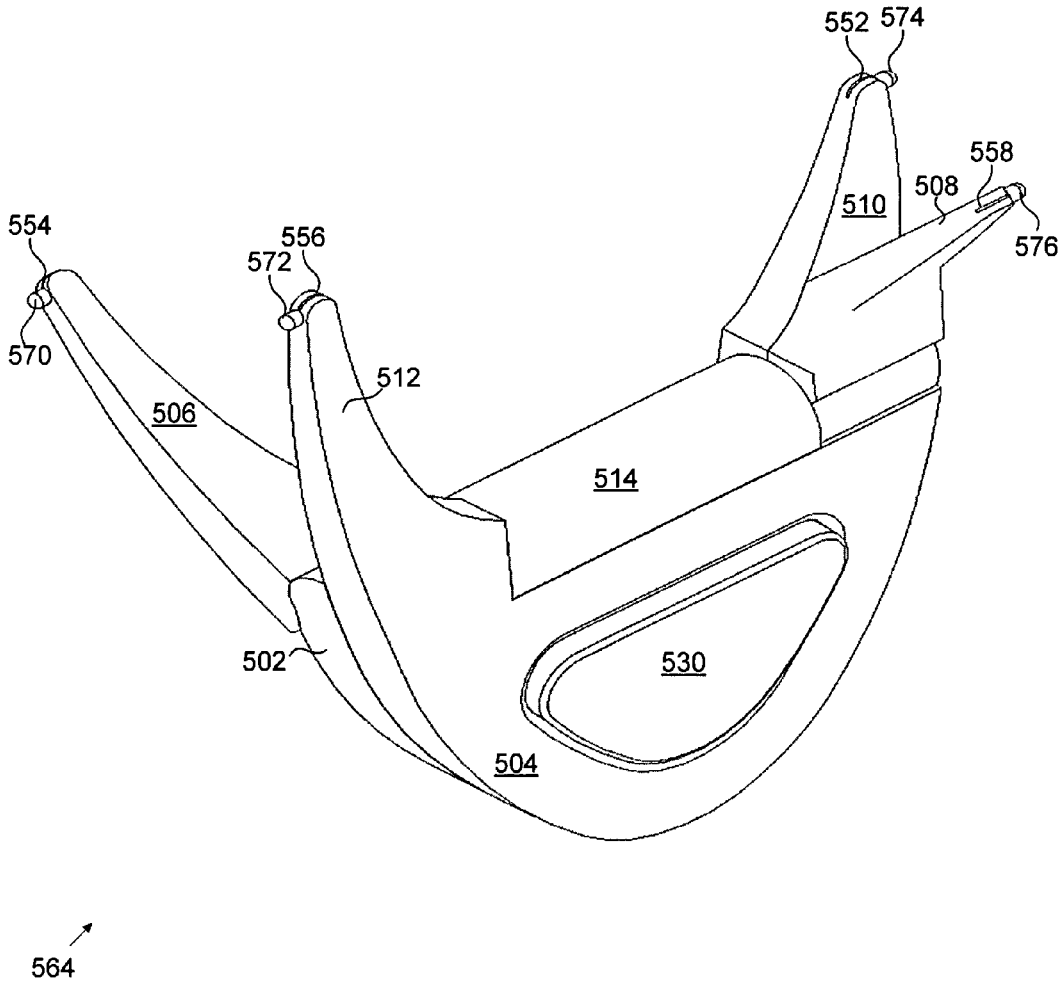
FIG. 5B is a perspective view of another exemplary epilation device.

FIG. 5B is a perspective view of another exemplary epilation device. As an example, device 564 and elements shown with reference numerals similar to those presented above may be similar or substantially similar to devices and elements shown and described above in connection with previous drawings. Here, device 564 includes rear body 502, front body 504, arms 506-512, axle 514, trigger 530, thread guides 552-558, and thread stops 570-576. In some examples, device 564 may be implemented differently than as described above in connection with FIG. 5A. Referring back to FIG. 5B, device 564 is shown in an assembled state. Rear body 502 and front body 504 may be coupled together using, for example, pins (e.g., pins 544-546), screws, nails, adhesive material of any type, or other techniques. In other examples, rear body 502 and front body 504 may be formed as a single, monolithic piece, providing an aperture for trigger 530 to protrude. Again, when trigger 530 is pressed, arm 506 rotates to a closed position (i.e., moves toward or closes) with arm 512 and arm 508 moves away from arm 510. Thread (not shown) secured in thread guide 552 is secured in thread guide 556. Likewise, thread secured in thread guide 554 is secured in thread guide 558. In other examples, a single or multiple threads may be used and secured in thread guides 552-558 and is not limited to the examples described above.

Thread (not shown) secured in pairs of diagonally opposing arms (e.g., thread guides 554 and 558; thread guides 552 and 556) may be twisted to create an axial twist, coil, or twist ("twist") of thread. When trigger 530 is pressed, arms 506 and 512 close and arms 508 and 510 open, causing a twist in a pair of twisted threads to move and roll in a direction towards arms 506 and 512. In other words, when arms 508 and 510 open, a separation force causes a twist (not shown) to roll towards arms 508 and 512, which are substantially simultaneously closing and generating less resistance to the rolling movement of a twist. In other examples, device 564 and the above-described elements may be varied in design, function, operation, configuration, materials, and dimensions and are not limited to the descriptions provided.

Figure 5C:
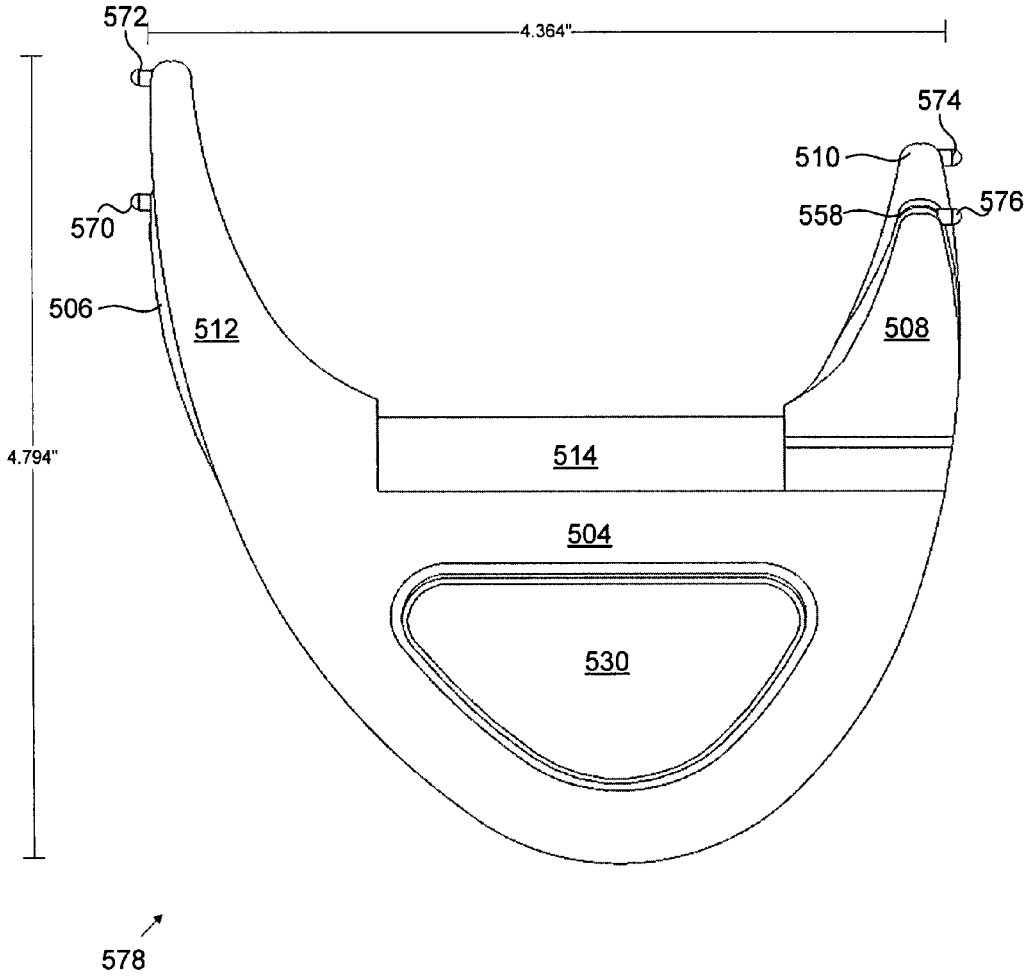
FIG. 5C is a front view of another exemplary epilation device.

FIG. 5C is a front view of another exemplary epilation device. As an example, device 578 and elements shown with reference numerals similar to those presented above may be similar or substantially similar to devices and elements shown and described above in connection with previous drawings. Here, device 578 includes front body 504, arms 506-512, axle 514, trigger 530, thread guide 558, and thread stops 570-576. In some examples, threads may be secured in thread guides 552-558 (thread guides 552-558 are not shown here due to the view) by thread stops 570-576, which may be disposed at the distal and proximal ends of a pair of threads strung between diagonally opposite arms, as described above. Further, threads (not shown) disposed between thread guides 552-558 may be implemented using any type of natural or synthetic threads or materials, including cotton, wool, polyester, plastic, nanotubes, or others.

Here, trigger 530 may be pressed (i.e., into a cavity formed between rear body 502 (not shown) and front body 504), causing arm 508 to roll along an axis parallel or substantially parallel to axle 514. Further, when trigger 530 is pressed, arm 506 rolls out and away from arm 512 along an axis that is parallel or substantially parallel to axle 514. In some examples, arms 510 and 512 may be fixed (i.e., unmoving or immobile) and formed as part of front as part of rear body 502 and front body 504, respectively. Device 578, in some examples, may be implemented using various dimensions and sizes, without limitation to any specific set of dimensions. For example, device 578 may be molded to an overall width of 4.364 inches and an overall height of 4.794 inches, as measured from the tip of arm 512 to the bottom of front body 504, as shown. In other examples, the sizes, lengths, widths, radii of curvature, and other dimensions for device 578 and the elements described herein may be varied and are not limited to the examples shown. The dimensions shown are for illustrative and exemplary purposes only and are not intended to be limiting or precise. In other examples, arms 510 and 512 may be implemented differently and are not limited to the fixed, immobile position or functions as shown and described. Further, device 578 and the above-described elements may be varied in design, function, operation, configuration, materials, and dimensions and are not limited to the descriptions provided.

Figure 5D:
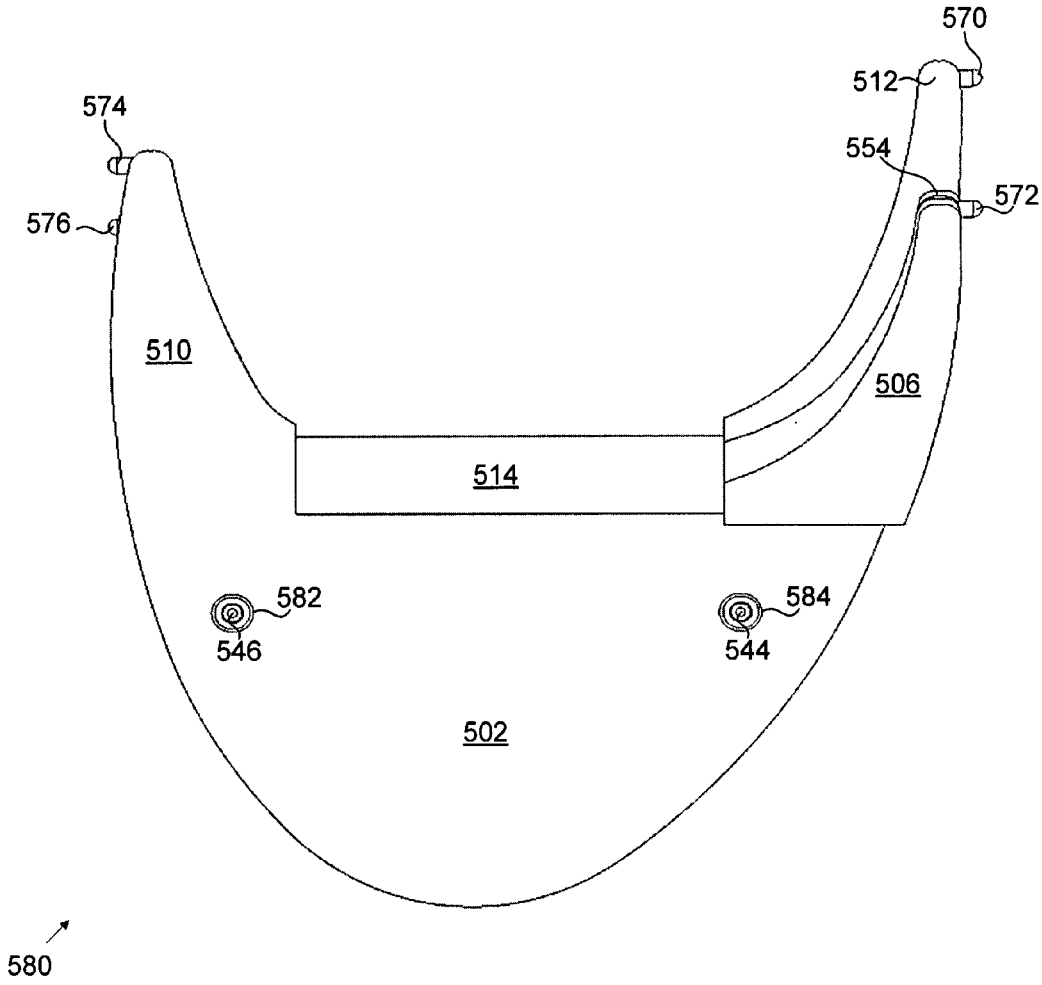
FIG. 5D is a rear view of another exemplary epilation device.

FIG. 5D is a rear view of another exemplary epilation device. As an example, device 580 and elements shown with reference numerals similar to those presented above may be similar or substantially similar to devices and elements shown and described above in connection with previous drawings. Here, device 580 includes rear body 502, arms 506, 510, and 512, axle 514, pins 544-546, thread guide 554, thread stops 570-576, and apertures 582-584. In some examples, rear body 502 may be secured, sealed, attached, or otherwise coupled ("coupled") to front body 504 (not shown), the latter of which may also be formed with arm 512 in a fixed, immobile position. Further, arm 510 may also be formed as a contiguous part of rear body 502. In other examples, any of arms 506 (not shown) or 508-512 may be formed contiguously or apart from any of the elements shown and described herein in connection with any of FIGS. 5A-5H. Still further, device 580 and the above-described elements may be varied in design, function, operation, configuration, materials, and dimensions and are not limited to the descriptions provided.

Figure 5E:
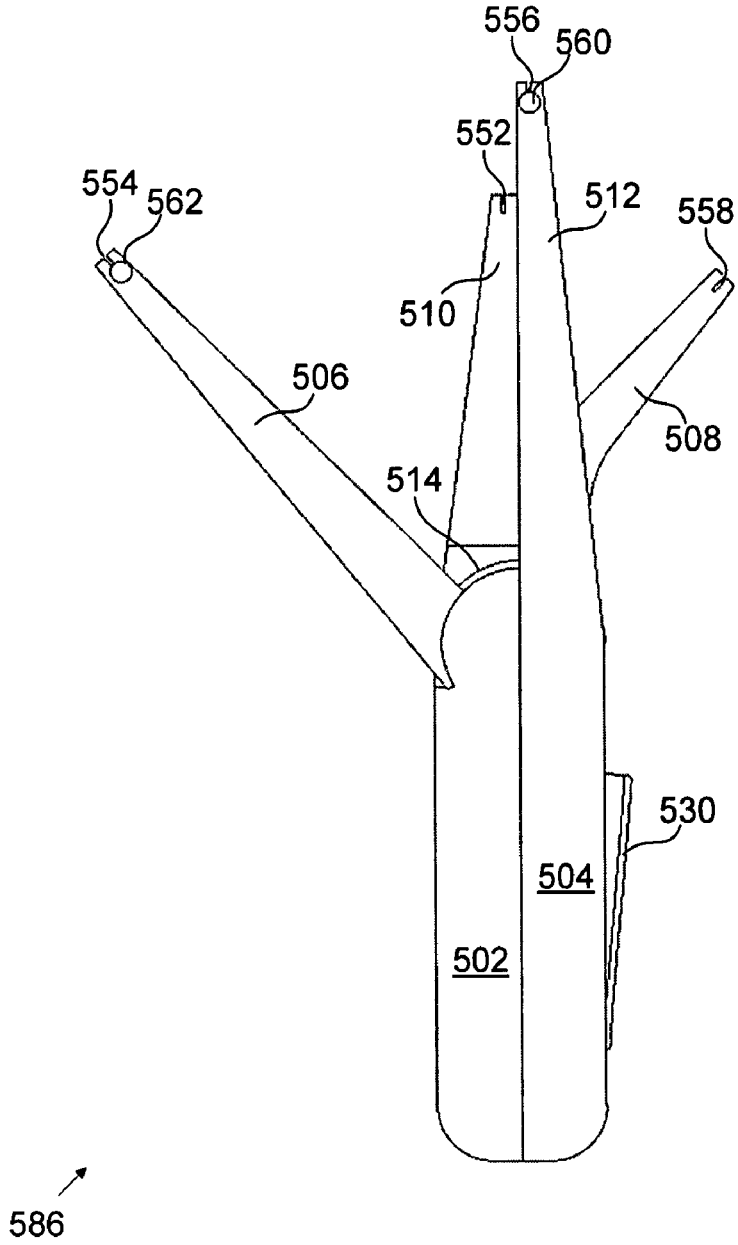
FIG. 5E is a left side view of another exemplary epilation device.

FIG. 5E is a left side view of another exemplary epilation device. As an example, device 586 and elements shown with reference numerals similar to those presented above may be similar or substantially similar to devices and elements shown and described above in connection with previous drawings. Here, device 586 includes rear body 502, front body 504, arms 506-512, axle 514, trigger 530, thread guides 552-558, and thread receptacles 560-562. As an illustration of a left side of device 586, thread receptacles 560-562 may be disposed along an outer surface of arms 506 and 512. Likewise, thread receptacles (not shown) may also be disposed along an outer surface of arms 508-510. In some examples, thread receptacles 560-562 may be implemented as recessions, depressions, pockets, holes, or receptacles formed at the distal end of arms 506-512. Threads (not shown) may be secured in thread guides 552-558 and thread receptacles 560-562. When twisted together and secured in thread guides 552-558 and thread receptacles 560-562 under tension, threads (i.e., a twist created by intertwining the threads between arms 506-512) may be used to engage and epilate hair from the surface of an arm, face, lip, brow, or other body part. Further, device 586 and the above-described elements may be varied in design, function, operation, configuration, materials, and dimensions and are not limited to the descriptions provided.

Figure 5F:
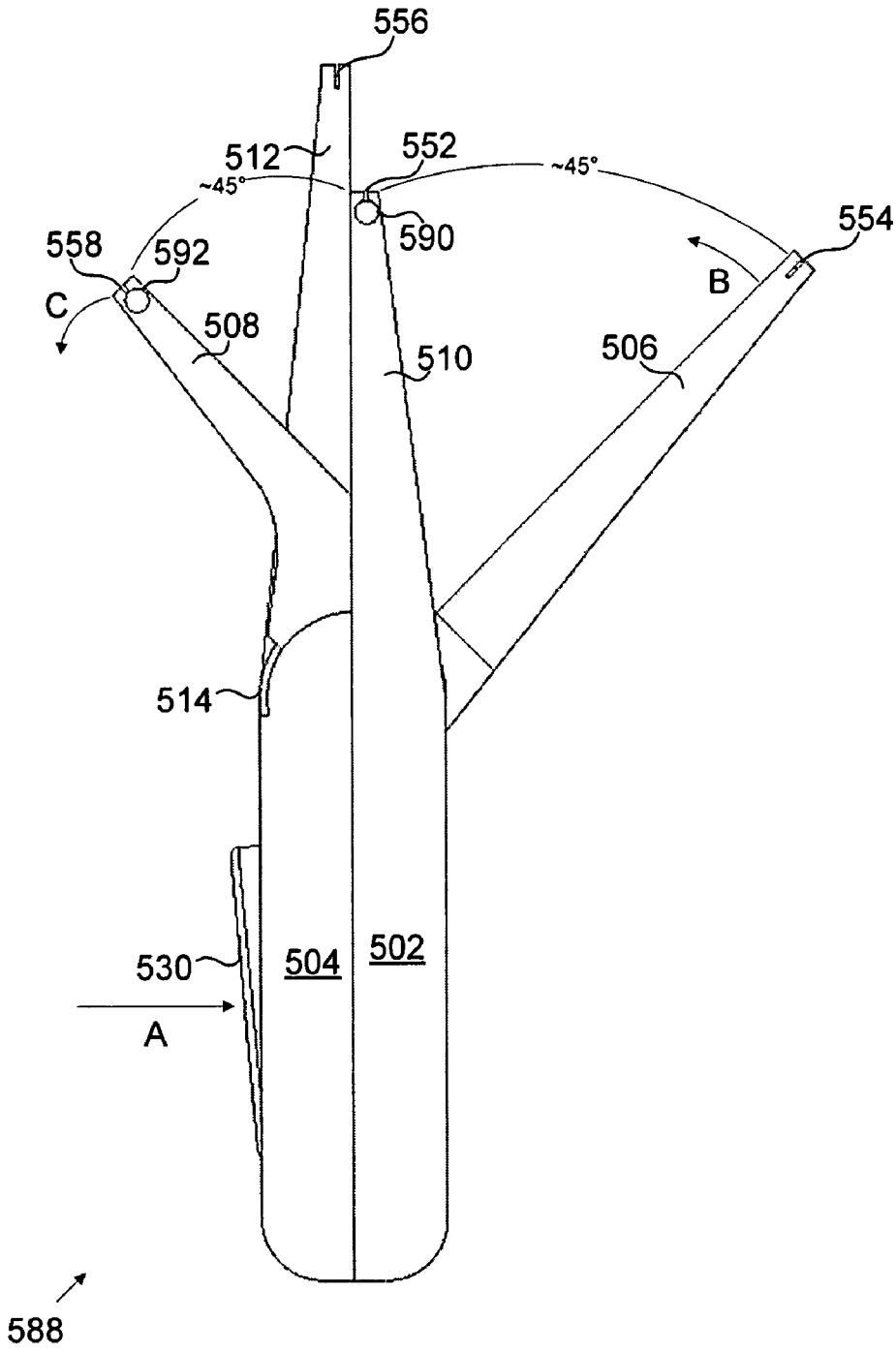
FIG. 5F is a right side view of another exemplary epilation device.

FIG. 5F is a right side view of another exemplary epilation device. As an example, device 588 and elements shown with reference numerals similar to those presented above may be similar or substantially similar to devices and elements shown and described above in connection with previous drawings. Here, device 588 includes rear body 502, front body 504, arms 506-512, axle 514, trigger 530, thread guides 552-558, and thread receptacles 590-592. When trigger 530 is pressed, arms 506-508 rotate along an axis that is parallel or substantially parallel to axle 514 (about an axis that is disposed at the center of axle 514 and that is perpendicular to a cross section of axle 514). In some examples, when trigger 530 is pressed, arms 506-508 rotate to the left about an axis that is parallel or substantially parallel to axle 514, thus causing arms 508-510 to open and arms 506-512 to close together, respectively. Alternatively, trigger 530 and spring 534 (FIG. 5A) may be implemented differently such that, when trigger 530 is pressed, arms 506-508 rotate to the right about an axis that is parallel or substantially parallel to axle 514. In still other examples, device 588 may be implemented differently to provide other actions apart from those shown and described. For example, in other examples, when trigger 530 is pressed, one or more of arms 506-512 may move and are not limited to the examples shown and described here arms 506-508 rotate about an axis that is parallel or substantially parallel to axle 514. As an example, arms 508-510 may be offset from each other at approximately 45 degrees in a resting position (i.e., trigger 530 has not been pressed). Further, arms 508-510 may be configured to move within an arc measured from 0 degrees to 150 degrees apart from each other. Further, the dimensions (e.g., length, width, depth, and others) of arms 506-512 may be varied and are not limited to any specific dimensions. As shown here, arms 506 and 512 may be configured to have an angular degree of separation, in a resting (i.e., non-operable) state, of 45 degrees. When trigger 530 is pressed (i.e., in the direction of arrow "A"), arm 506 may be configured to close to less than 45 degrees of separation from arm 512 (i.e., in the direction of arrow "B"). Likewise, when trigger 530 is pressed (i.e., in the direction of arrow A), arm 508 may be configured to rotate and open away from arm 510 to more than 45 degrees (i.e., in the direction of arrow "C"). In some examples, the degree of angular separation between arms 508 and 510, may be configured to open to 45, 90, or any other angular degree of separation up to and including 180 degrees. In some examples, when trigger 530 is released, arm 508 rotates back (i.e., in the opposite direction of arrow "C") and closes with arm 510 to an angular separation of 45 degrees. In other examples, arms 506-508 may be configured to rotate to less than or more than 45 degrees of separate from arms 510 and 512, respectively. In still other examples, arms 506-508 may be configured to move in directions opposite to those described herein and are not limited to the descriptions provided. As an example, arms 506-512 may be designed, formed, and configured to varying lengths. For example, arm 508 may be 1.234 inches in length as measured along the edge forming an intersection (i.e., angle) with the adjacent edge of arm 510. Likewise, arm 506 may be 2.021 inches in length as measured along the edge of arm 506 forming an intersection with the opposing, adjacent edge of arm 510. In other examples, the above-described dimension may be varied and are not limited to the examples provided. Device 588 may be implemented as a handheld device that allows for a user to operate trigger 530 while manipulating a body part of, for example, a person undergoing epilation. Further, device 588 and the above-described elements may be varied in design, function, operation, configuration, materials, and dimensions and are not limited to the descriptions provided.

Figure 5G:
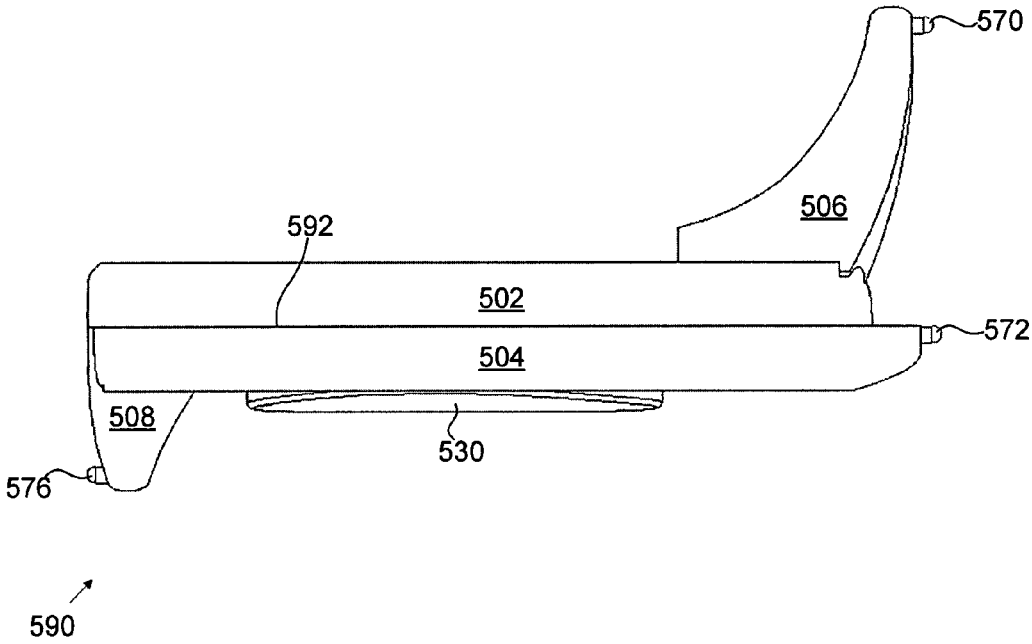
FIG. 5G is a bottom view of another exemplary epilation device.

FIG. 5G is a bottom view of another exemplary epilation device. As an example, device 590 and elements shown with reference numerals similar to those presented above may be similar or substantially similar to devices and elements shown and described above in connection with previous drawings. Here, device 590 includes rear body 502, front body 504, arms 506-508, trigger 530, thread stops 570-572 and 576, and seam 592. When viewed from beneath (i.e., underneath), seam 592 may be visible, showing a joint, fissure, or other contact area where rear body 502 and front body 504 are mated, joined, sealed, or otherwise coupled together. In other examples, seam 592 may not be visible or barely visible. In still other examples, seam 592 may not be presented if, instead of using rear body 504 and front body 502, a single body element is used and formed. In other words, rear body 502 and front body 504 may be replaced with a single element (e.g., a monolithic, cold or injection-molded body). Further, device 590 and the above-described elements may be varied in design, function, operation, configuration, materials, and dimensions and are not limited to the descriptions provided.

Figure 5H:
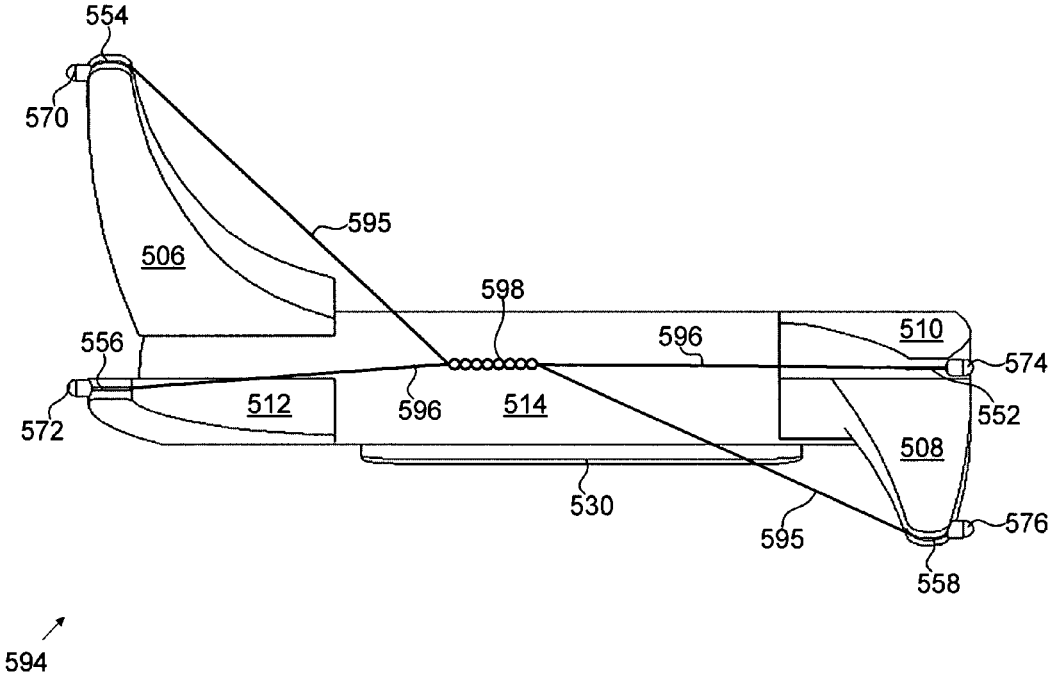
FIG. 5H is a top view of another exemplary epilation device.

FIG. 5H is a top view of another exemplary epilation device. As an example, device 594 and elements shown with reference numerals similar to those presented above may be similar or substantially similar to devices and elements shown and described above in connection with previous drawings. Here, a top view of device 594 illustrates arms 506-512, axle 514, trigger 530, thread guides 552-558, thread stops 570-576, threads 595-596, and axial twist ("twist") 598. In some examples, thread stops 570-576 and threads 595-598 may be implemented together. For example, thread 595 may have thread stops 570 and 576 at each end of the thread. In some examples, thread stops 570-576 may be implemented as beads, washers, balls, or other molded, fabricated, manufactured, melted, or other elements coupled to the end of threads 595-596. When threads 595-596 are placed within thread guides 552-558, thread stops 570-576 are used to hold threads 595-596 in place (i.e., within thread guides 552-558) to prevent slippage and to maintain tension. Further, when threads 595-596 are twisted together, twist 598 is formed. When placed under tension, twist 598 may move (e.g., roll) in a general direction towards or away from the pairs of arms (i.e., arms 508-510 and arms 506 and 512, respectively) when trigger 530 is operated. When pressed, trigger 530 and teeth 520 (not shown) disposed on top of trigger 530 engages teeth 518 (not shown) under axle 514. Subsequently, axle 514 pivots about axis 516 (not shown) rotating arms 506-508 towards or away from arms 510-512. As arms 506-508 rotate, twist 598 rolls and moves laterally. As twist 598 moves, hairs are engaged by the individual twists of twist 598 and, as further movement of twist 598 occurs, a rotating and pulling action are achieved, causing hairs to be engaged and removed by the follicle (i.e., epilated). The rolling and lateral movement engages hair and, as the movement continues, greater surface contact between hair and twist 598, allowing hair to be epilated (i.e., removed by the follicle), instead of breaking or cutting and leaving the follicle in the epidermis intact. In other examples, device 594 and the above-described elements may be varied in design, function, operation, configuration, materials, and dimensions and are not limited to the descriptions provided.

Although the foregoing examples have been described in detail for purposes of clarity of understanding, certain changes and modifications may be practiced within the scope of the appended claims. Accordingly, the present examples are to be considered as illustrative and not restrictive, and not limited to the details given herein and may be modified within the scope and equivalents of the appended claims. In the claims, elements and/or steps do not imply any particular order of operation, unless explicitly stated in the claims.

What is claimed is:

1. An epilation device comprising:

a body comprising a front part and a rear part, wherein the front part comprises a first arm and the rear part comprises a second arm; wherein the first arm and the second arm are diagonally across from each other;

and wherein the first arm and the second arm are integral parts of the body;

an axle having the third arm disposed at one end of the axle and a fourth arm disposed at the other end of the axle, wherein the third arm and the fourth arm are integral parts of the axle and the third arm and the fourth arm are diagonally across from each other;

wherein a spring is configured to provide a rotational force to rotate the axle, the third arm and the fourth arm, and the axial rotation, when a trigger coupled to the spring is pressed the rotation of the axle causes the third arm to move closer to and farther away from the first arm and the fourth arm to move farther away and closer to the second arm and wherein the axial rotation causes the twisting of the thread;

and a trigger coupled to a spring, the trigger being substantially housed within the body and being partially exposed through an aperture in the body, wherein the first and the third arm are on one side of the trigger and the second and the fourth arm are on the other side of the trigger.

2. The apparatus of claim 1, further comprising a first thread disposed between the first arm and the third arm.

3. The apparatus of claim 2, wherein the thread comprises two or more lengths.

4. The apparatus of claim 2, further comprising a second thread disposed between the second arm and the fourth arm.

5. The apparatus of claim 1, further comprising a thread coupled to the first arm and the fourth arm, wherein the first arm and the fourth arm are disposed on the front part of the body.

6. The apparatus of claim 5, further comprising another thread coupled to the second arm and the third arm, wherein the second arm and the third arm are on the rear part of the body.

7. The apparatus of any of claim 1, wherein the arms are made of the same material.

8. The apparatus of claim 1, wherein the first arm and the third arm are on one side of the apparatus corresponding to one end of the axle, and wherein the second arm and the fourth arm are on the other side of the apparatus corresponding to the other end of the axle.

* * * * *